US011428032B2

(12) United States Patent
Sturm et al.

(10) Patent No.: US 11,428,032 B2
(45) Date of Patent: Aug. 30, 2022

(54) LOCK FOR A MOTOR VEHICLE

(71) Applicant: Kiekert AG, Heiligenhaus (DE)

(72) Inventors: Christian Sturm, Krefeld (DE); Bernhard Drost, Isselburg (DE)

(73) Assignee: Kiekert AG, Heiligenhaus (DE)

( * ) Notice: Subject to any disclaimer, the term of this patent is extended or adjusted under 35 U.S.C. 154(b) by 206 days.

(21) Appl. No.: 16/605,843

(22) PCT Filed: Mar. 2, 2018

(86) PCT No.: PCT/DE2018/100189
§ 371 (c)(1),
(2) Date: Oct. 17, 2019

(87) PCT Pub. No.: WO2018/192609
PCT Pub. Date: Oct. 25, 2018

(65) Prior Publication Data

US 2021/0277689 A1 Sep. 9, 2021

(30) Foreign Application Priority Data

Apr. 19, 2017 (DE) ..... 10 2017 108 265.4

(51) Int. Cl.
*E05B 83/24* (2014.01)
*E05B 81/14* (2014.01)
(Continued)

(52) U.S. Cl.
CPC ..... *E05B 83/24* (2013.01); *E05B 81/14* (2013.01); *E05B 81/20* (2013.01); *E05B 85/243* (2013.01); *E05B 85/26* (2013.01); *E05B 83/243* (2013.01)

(58) Field of Classification Search
CPC ..... E05B 83/24; E05B 81/20; E05B 81/14; E05B 81/18; E05B 85/26; E05B 85/243;
(Continued)

(56) References Cited

U.S. PATENT DOCUMENTS 9,617,762 B2 * 4/2017 Fannon ..... E05B 83/24
10,378,252 B2 * 8/2019 Ottino ..... E05B 81/68
(Continued)

FOREIGN PATENT DOCUMENTS

DE 10309643 A1 9/2004
DE 202008015789 U1 4/2010
(Continued)

OTHER PUBLICATIONS

International Search Report and Written Opinion for corresponding Patent Application No. PCT/DE2018/100189 dated May 25, 2018.

*Primary Examiner* — Kristina R Fulton
*Assistant Examiner* — Noah Horowitz
(74) *Attorney, Agent, or Firm* — Renner, Otto, Boisselle & Sklar, LLP

(57) ABSTRACT

A lock for a motor vehicle, in particular a bonnet lock, having a locking mechanism with a rotary latch and at least one pawl, a locking pin and an ejector interacting with the locking pin, wherein the locking pin can be brought into a lifting-off position by means of the ejector, and with at least one electrically actuable means for moving the lock holder from the lifting-off position into a locking position, wherein a drive lever can be brought into engagement with the ejector, and wherein the drive lever interacts with a pull-closed lever, wherein the drive lever is connectable to the rotary latch by means of the pull-closed lever only after a securing position is reached.

20 Claims, 2 Drawing Sheets

Figure 1:
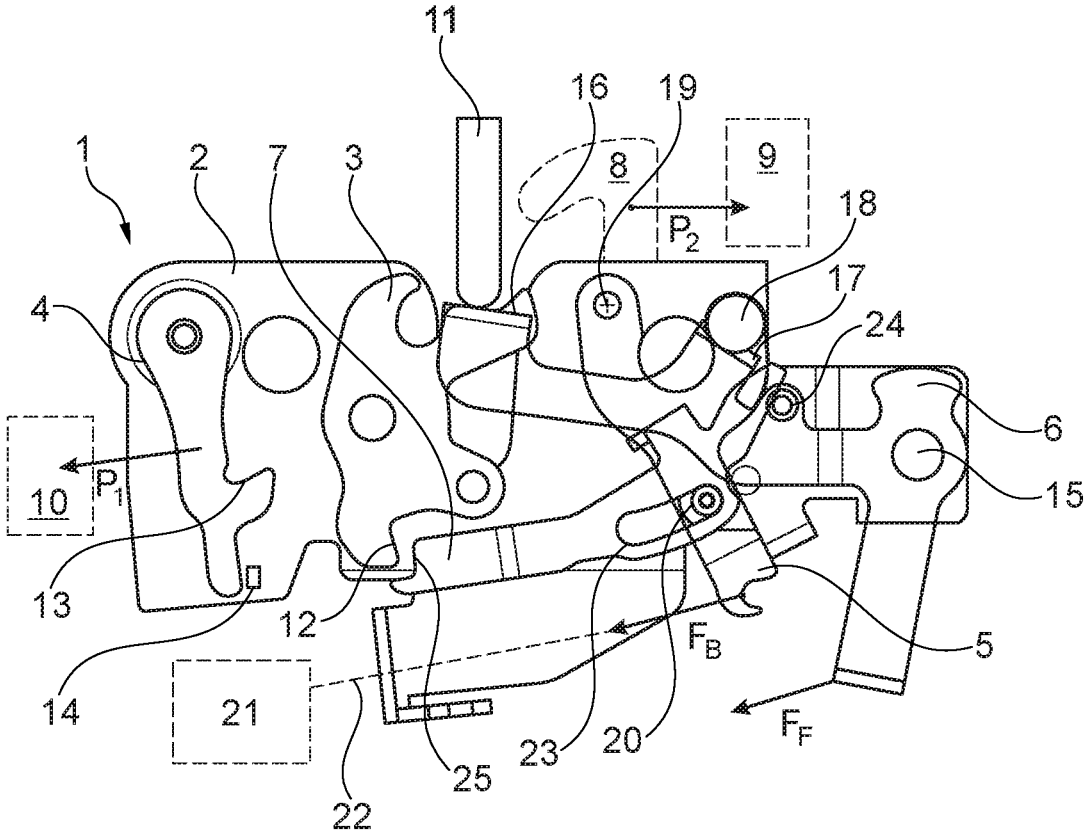

(51) Int. Cl.
*E05B 81/20* (2014.01)
*E05B 85/24* (2014.01)
*E05B 85/26* (2014.01)

(58) Field of Classification Search
CPC ..... Y10S 292/14; Y10S 292/23; Y10T 292/1082; Y10T 292/1047
See application file for complete search history.

(56) References Cited

U.S. PATENT DOCUMENTS

| | | | | |
|---|---|---|---|---|
| 10,669,751 | B2 * | 6/2020 | Kim | E05B 81/72 |
| 10,767,396 | B2 * | 9/2020 | Distefano | E05B 85/26 |
| 2019/0003217 | A1 * | 1/2019 | Schiffer | E05B 83/24 |
| 2019/0145135 | A1 * | 5/2019 | Lebsak | E05B 81/20 292/229 |
| 2019/0226247 | A1 * | 7/2019 | Johann | E05B 81/16 |
| 2021/0095499 | A1 * | 4/2021 | Sturm | E05B 81/16 |

FOREIGN PATENT DOCUMENTS

| | | | | |
|---|---|---|---|---|
| DE | 102013109051 | A1 | 2/2015 | |
| DE | 102014003737 | A1 | 9/2015 | |
| DE | 102014109111 | A1 | 12/2015 | |
| DE | 102014115239 | A1 | 4/2016 | |
| DE | 102014117330 | A1 * | 6/2016 | E05B 63/0056 |
| WO | 2015/139678 | A1 | 9/2015 | |

* cited by examiner

LOCK FOR A MOTOR VEHICLE

The invention relates to a lock for a motor vehicle, in particular a bonnet lock, having a locking mechanism comprising a rotary latch and at least one pawl, a locking pin and an ejector that interacts with the locking pin, it being possible for the locking pin to be brought into a lifting-off position by means of the ejector, and comprising at least one electrically actuable means for moving the lock holder from the lifting-off position into a locking position.

Locks or locking systems for motor vehicles are used where it is necessary to hold doors, hatches or movable components on motor vehicles in order to ensure safe driving of the motor vehicle. Although the locking systems are used primarily for holding the movable components in the locking position thereof, today there is an increasing focus on comfort functions. In this case, doors, hatches or bonnets can be electrically actuated during the opening and/or locking process for example, as a result of which opening of the locking system and/or locking of the movable component can be performed in an electrically assisted manner.

In addition to the comfort characteristics of electrically actuated locking systems, the operating and usage properties of motor vehicles change for example if motor vehicles are equipped for example with electrical drives. Although there are few motor vehicles today which have a trunk that is arranged for example under a front bonnet, the trend in vehicles having an electrical drive means that it is increasingly the case that the resulting space is also useable as a trunk. In this case, a trunk can be closed by means of a seal, so that tightness for example to water or contamination is ensured. In this case, a seal causes a counterpressure to oppose the locking mechanism, as a securing element, when locking the lock. Locking systems for electrical locking of a lock have become known from the state of the art.

For example, the German patent application DE 10 2013 109 051 A1 discloses an electrically actuable lock that addresses the object of minimizing gaps or joints in the case of doors or hatches. The lock known herefrom is movable, specifically is in particular pivotably mounted. Following latching of the locking mechanism, the lock is moved or pivoted as a whole, by a drive, so that a gap between the door or hatch and the vehicle body is minimized. The drive provided therefor comprises an electric motor and a pivotable lever, referred to as a swing arm. Pivoting of the swing arm by the electric motor causes the lock as a whole to be pivoted so that the gap is minimized. In this case, the lock housing is held by a detent which is pivotably attached to the swing arm. The locking device known from this document thus comprises a drive by means of which the lock as a whole, and thus also the locking mechanism, can be moved so that a door gap or hatch gap can be reduced following locking of a door or hatch.

A danger that occurs in the case of electrically actuable locks is that body parts or objects may become trapped during the electrically actuated tightening of the lock. In order to prevent trapping, in particular catching of body parts, anti-trap protection has become known from the prior art.

DE 10 2014 109 111 A1 discloses an electrically actuable bonnet lock, comprising a locking mechanism having a rotary latch and at least one pawl for latching the rotary latch, and an electrical drive for moving components of the locking device, wherein a cam plate, which can be rotated by the electrical drive and can move a plurality of components by one rotational movement, has become known. The position of the rotary latch can be raised and lowered by pivoting a transmission lever about the axis thereof, in order to thereby subsequently be able to change a gap between the bonnet and the vehicle body following latching. In order to prevent trapping during locking, the bonnet is placed on an ejector lever during the locking process, following which the bonnet lowers further in an electromotive manner, the ejector lever being lowered. In this phase, the bonnet can be raised at any time, because the rotary latch is not yet latched. There is therefore no danger of fingers being trapped. Only after reaching a gap of approximately 4-8 mm is the rotary latch pivoted into the ratchet position thereof, so that the bonnet is pivoted into the locking position thereof by means of electrical driving of the rotary latch. Both the structural complexity of pulling closed, and the new requirements with respect to overcoming a sealing pressure, present new tasks for development. This is where the invention starts from.

The invention addresses the technical problem of developing a motor vehicle lock of this kind in such a way that a high level of safety can be achieved and at the same time a sufficient force can be provided for locking the motor vehicle lock. Furthermore, the object of the invention is that of providing a structurally simple and cost-effective locking system.

The problem is solved by the features of independent claim 1. Advantageous embodiments of the invention are specified in the dependent claims. It is noted that the exemplary embodiments described in the following are not limiting; instead, any variations of the features described in the description and the dependent claims are possible.

According to claim 1, the object of the invention is achieved in that a lock for a motor vehicle, in particular a bonnet lock, is provided, having a locking mechanism comprising a rotary latch and at least one pawl, a locking pin and an ejector that interacts with the locking pin, it being possible for the locking pin to be brought into a lifting-off position by means of the ejector, and comprising at least one electrically actuable means for moving the lock holder from the lifting-off position into a locking position, it being possible for the drive lever to be brought into engagement with the ejector, and for the drive lever to interact with a pull-closed lever, the drive lever being connectable to the rotary latch by means of the pull-closed lever only after a securing position is reached. The design of the lock according to the invention now creates the possibility of providing a safety lock that allows for secure locking of the motor vehicle lock and furthermore a locking system that is secure and is provided with sufficient force in order to transfer a movable component into a locking position in an electrically actuated manner.

In particular, the separation between the locking position and the securing position, and the engagement of the drive lever only at a time at which the securing position of the component to be moved, for example an engine bonnet, is reached, makes it possible for components that are to be moved to be opened at any time, until the securing position is reached, so that trapping can be prevented. In this case, the invention distinguishes between the drive lever and the pull-closed lever, as separate components which interact but are detachably interconnected. Only by connecting the drive lever to the rotary latch, via the pull-closed lever, is for example the engine bonnet actively pulled closed, it being possible for trapping to be prevented at this time by the safety position.

An advantageous variant of the invention results when the pull-closed lever can be brought into engagement with the drive lever only after a securing position is reached.

In this case, bonnet locks are preferably used as locking systems for motor vehicles. It is also conceivable, however, to use the lock according to the invention in hatches, covers, sliding doors, or side doors. The motor vehicle locks covered by the invention are used wherever electrical actuation, i.e. electrically assisted pulling closed and/or opening is to be made possible. Electrically actuated motor vehicle locks of this kind are also referred to as servo locks.

A locking mechanism comprising a rotary latch and at least one pawl is common to all these locking systems, it being possible for the rotary latch to be held in a locked position by means of the pawl. In this case, single-step lock mechanisms consisting of a pre-ratchet and a main ratchet, as well as systems comprising one or two pawls, are used. The invention is preferably directed to a locking mechanism comprising a main ratchet position and a pawl, but this does not apply in a limiting manner.

The locking mechanism interacts with a locking pin. The locking pin may be fastened to the motor vehicle body or may be provided for example mounted on a hatch or bonnet. If the locking system is used for example in the region of a bonnet, the locking pins or the lock holder are preferably mounted on the bonnet. The bonnet is then closed, by means of the bonnet being moved towards the locking system and being able to be placed on an ejector.

The ejector is part of the motor vehicle locking system and interacts with the locking pin, the locking pin being able to be brought into a lifting-off position by means of the ejector. In this case, the lifting-off position is the position in which the bonnet, for example, rests on the ejector and is held by the ejector in the lifting-off position. The ejector is preferably spring-loaded. Following opening of the locking mechanism, and thus release of the locking pin, the locking pin can be moved into the lifting-off position, by means of the ejector and in particular by the force of the spring acting on the ejector.

The servo lock or the electrically actuable lock comprises an electrically actuable means for moving the lock holder from the lifting-off position into a locking position. In this case, the locking position is determined by the lock holder, and thus the movable component, being in the secured position thereof on the motor vehicle. The bonnet, the door and/or hatch is closed. The lock holder is held in the locked locking mechanism and is preferably in a main ratchet position.

In order to transfer the lock holder from the lifting-off position into the securing position, a drive lever can be brought into engagement with the ejector. The drive lever is electrically actuable and capable of moving the ejector, and thus the lock holder, into the securing position, against the force of the spring. Only when the securing position is reached, in which position trapping can be prevented, does the drive lever interact with a pull-closed lever so that the lock holder can be transferred from the securing position into the locking position.

An advantageous variant of the invention then results when the pull-closed lever can be brought into engagement with the rotary latch in an interlocking manner, in the securing position. In this case, interlocking engagement of the pull-closed lever in the rotary latch allows for reliable force transmission from the pull-closed lever to the rotary latch, so that the transmission of higher forces, such as are necessary for pulling closed against a seal, can be made possible. In this case, the pull-closed lever can for example engage in an interlocking manner in the rotary latch, so that reliable transmission of the force, and furthermore reliable movement of the rotary latch, can be made possible, also within the context of a pivot movement.

It may also be advantageous for the rotary latch to be able to be brought into engagement with the lock holder in an interlocking manner in the securing position. In this case, the interlocking engagement of the rotary latch in the lock holder again allows for reliable transmission of high forces, so that the lock holder, and in particular for example a bonnet of a motor vehicle, can be transferred into the locking position against the pressure of a seal. In this case, it is ensured that trapping is prevented, since the securing position is reached only at a time at which the lock holder, and thus the component located on the lock holder, is in a position in which trapping at least of a body part can be prevented by the securing position. If the lock holder is for example circular and/or cylindrical, the rotary latch can also comprise a round and/or cylindrical recess which can be brought into engagement with the lock holder in order to reach the securing position.

The locking system is designed such that the rotary latch can already be brought into engagement with the lock holder in the lifting-off position. The rotary latch is also pivoted, in particular by lowering or moving the ejector. Only as a result of the interaction of the pivot movement of the rotary latch and the electrically actuated pivot movement of the ejector does the rotary latch reach the securing position, so that the pull-closed lever can be brought into engagement with the rotary latch. These securing measures, too, prevent premature pulling closed, and thus trapping.

If the rotary latch can be pivoted by means of the pull-closed lever, the rotary latch being transferrable from a securing position into a locking position, then a further advantageous variant of the invention results. If the rotary latch reaches a securing position, the pull-closed lever is capable of interacting with the rotary latch. When the securing position is reached and the pull-closed lever engages in the rotary latch, the rotary latch can be moved by the pull-closed lever. In this case, the rotary latch preferably performs a pivot movement, the pull-closed lever being movable by the drive lever towards the rotary latch. The rotary latch can be pivoted so far, by the pull-closed lever, that a pawl interacting with the rotary latch can be brought into engagement with the rotary latch. The pull-closed lever can preferably pivot the rotary latch so far that the rotary latch reaches an excess travel position, so that secure engagement of the pawl in the rotary latch can be ensured. The excess travel position is characterized in that the rotary latch is pivoted beyond the locking position, so that sufficient play can be provided for engagement of the pawl in the rotary latch. The pawl is preferably brought into engagement with the rotary latch in a spring-loaded manner.

In an advantageous variant of the invention, the securing position can be determined by a locking position of a component that is movably connected to the motor vehicle, a locking position being definable by a clearance between the movable component and the motor vehicle body, and a locking position as a securing position being able to be reached at a clearance of ≤10 mm, preferably ≤6 mm and more preferably ≤4 mm. Reaching the securing position is thus determined by the movable component and in particular by the spacing between the movable component and the motor vehicle body. In the case of a clearance of <10 mm and preferably ≤6 mm, it is possible to ensure that no body part can any longer enter the gap between the movable component and the vehicle body. Trapping can thus be prevented, and reliable anti-trap protection can be achieved. If anti-trap protection can be achieved, achievement of an invisible joint can also be made possible. In this case, an invisible joint is determined by the movable component coming into abutment against a further component of the motor vehicle. This is an aim in the development of motor vehicles, for example for visual reasons, or owing to a reduction in an air resistance of the motor vehicle.

If the pull-closed lever comprises a recess, the recess being able to be brought into engagement with the rotary latch, a further advantageous embodiment of the inventive concept can be achieved. If the rotary latch comprises an undercut or an extension for example, in which the pull-closed lever can be engaged, it is thereby possible to achieve secure engagement of the pull-closed lever in the rotary, and the leverage ratios between the pull-closed lever and the rotary latch can also be set. It is thus possible, in an advantageous manner, to influence the available forces by pulling closed the movable component, reliable movement of the rotary latch simultaneously being able to be made possible.

It may also be advantageous for the rotary latch to comprise an extension, in particular a cylindrical pin, the extension being able to be brought into engagement with the pull-closed lever. A cylindrical pin is a cost-effective component that can also be easily connected to the rotary latch. Furthermore, a pin-like extension forms favorable engagement ratios for the pull-closed lever, since the cylindrical contact surface makes it possible for the same engagement ratios to be provided, for the pull-closed lever on the rotary latch, at all times.

In fact, the drive lever interacts alternately with the ejector, in order to transfer the lock holder from the lifting-off position into the securing position, and with the pull-closed lever in order to transfer the lock holder from the securing position into the locking position. In this case, this interaction among the drive lever, ejector and pull-closed lever allows for the force transmission between the drive lever, ejector and pull-closed lever to be designed with respect to the necessary force. It is in particular advantageous for the ejector, and thus for example the bonnet, to move swiftly during the movement, and thus the interaction between the drive lever and the ejector can generate a low transmission during passive lowering. The interaction between the drive lever and the pull-closed lever at a high transmission advantageously allows for a high force to be provided, so that suitable moments for locking the lock or for transferring the lock holder into the locking position can be provided.

It is advantageously possible for the drive lever to be able to be pivotably mounted in a lock case of the lock. The drive lever is accommodated in the motor vehicle lock independently of the ejector, the rotary latch and the pull-closed lever. The separate mounting of the drive lever makes it possible for optimal engagement ratios between the ejector, pull-closed lever and rotary latch to be achieved. In particular, the transmission ratios between the drive lever, ejector and pull-closed lever can be set in a structurally favorable and simple manner.

The possibility of the pull-closed lever being able to be guided and/or mounted in the drive lever may also be advantageous and form a further embodiment of the invention. A structurally favorable and thus advantageous mounting for the pull-closed lever results when the pull-closed lever can be mounted directly on the drive lever. In this case, the pull-closed lever can comprise a guide for the drive lever, so that the drive lever can be guided in the pull-closed lever, for example for displacing or moving the ejector, without the pull-closed lever assisting or influencing the process of pulling closed. In this case, the pull-closed lever may be guided for example in the lock or lock case and be supported on the drive lever. Only during the transfer of the lock holder from the securing position into the locking position does the drive lever move the pull-closed lever and come into force-transmitting engagement with the pull-closed lever, for example in the guide. The design according to the invention of the motor vehicle lock creates the possibility of providing an improved locking system that can ensure an extremely high level of safety for the operator.

The invention will be explained in greater detail in the following, with reference to the accompanying drawings and on the basis of a preferred exemplary embodiment. The principle applies, however, that the exemplary embodiment does not limit the invention but is merely one embodiment. The features shown can be implemented individually or in combination with further features from the description and from the claims.

Figure 2:
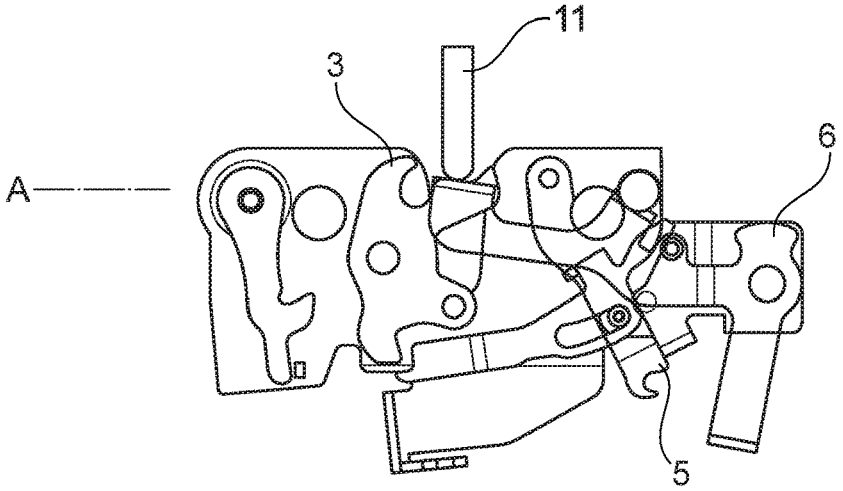
Figure 3:
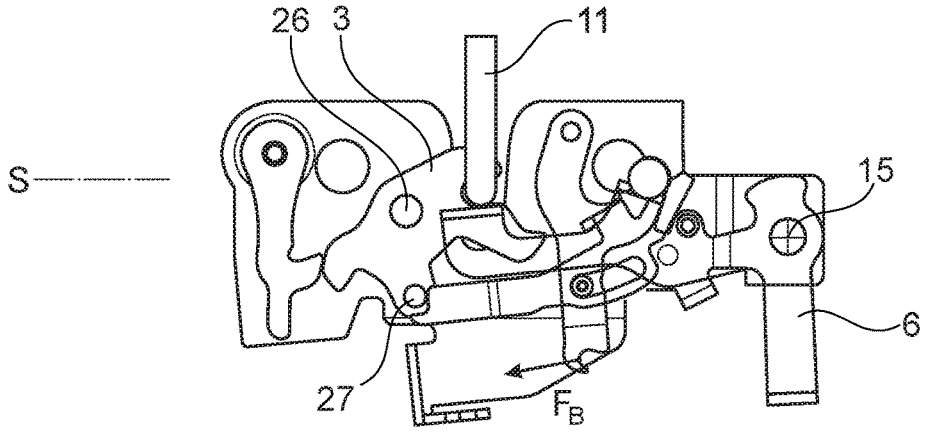
Figure 4:
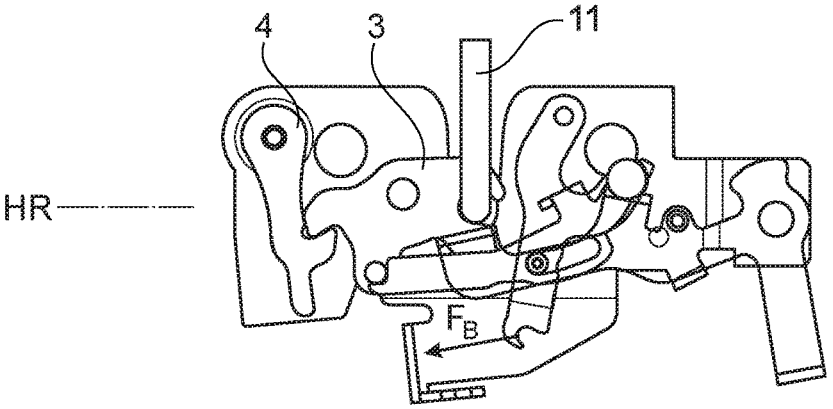

In the drawings:

FIG. 1 is an only partial side view of a motor vehicle lock according to the invention, in a lifting-off position, the lock holder resting on the ejector and an arrester hook being brought out of engagement with the lock holder, FIG. 2 shows the lock according to FIG. 1 in a lifting-off position, FIG. 3 shows the lock according to FIG. 1 in a securing position, FIG. 4 shows the lock according to FIG. 1 in a locking position.

A region of a motor vehicle lock 1 is shown in FIG. 1. The lock 1 comprises a lock case, a rotary latch 3, a pawl 4, a drive lever 5, an ejector 6, a pull-closed lever 7, an arrester hook 8, and two electrical control means in the form of microdrives 9, 10. A lock holder 11 rests on the ejector 6, as a result of which the lifting-off position of the lock can be determined.

The rotary latch 3 and the pawl 4 form the locking mechanism, it being possible for the pawl 4 to be latched into the rotary latch 3 and in particular into an extension 12. In this case, the extension 12 latches into a hook-shaped contour 13 of the pawl 4. In the present design, the pawl 4 is pre-loaded, by means of a spring, in the anticlockwise direction, and abuts for example against a stop 14 in the lock case 2. The pawl 3 can be moved in the clockwise direction, in the direction of the arrow P1, by the control means 10. The control means can for example be a linear microdrive which can pivot the pawl 4 in the clockwise direction and thus move it into a position in which the pawl 4 comes out of engagement with the rotary latch 3.

The ejector 6 is accommodated in the lock case 2 so as to be pivotable about a shaft 15. The ejector 6 is pre-loaded, in the clockwise direction, by the force $F_F$ of a spring (not shown). The spring force $F_F$ holds the ejector 6 in the position shown in FIG. 1, so that the lock holder 11, and consequently for example an engine bonnet, can be held in the lifting-off position. The lock holder 11 is out of engagement with the rotary latch 3 and rests loosely on the ejector 6 and the rotary latch 3. The ejector 6 comprises a first contact surface 16 and a second contact surface 17. The lock holder 11 rests on the first contact surface 16, which may for example be formed by a bevel on the ejector 6. The drive lever 5 engages on the second contact surface 17. The ejector can be manufactured for example as a sheet-metal punched part, made of a steel, it being possible for the contact surfaces 16, 17 to be provided as bevels, for example.

The drive lever 5 acts on the ejector by means of a driver 18. The drive lever 5, in turn, is accommodated in the lock case 2 so as to be pivotable about the shaft 19. The drive lever 5 furthermore comprises a bearing, drive and guide pin 20. The pin 20 is used for mounting the pull-closed lever 7 and for driving pull-closed lever 7.

The drive lever 5 is actuated for example by means of a pull-closed drive 21 and by means, for example, of a Bowden cable 22 (shown merely by dashed lines). A force $F_B$ can be introduced into the drive lever 5 by means of the Bowden cable 22. The drive lever is thus moved about the shaft 19, in the clockwise direction, by the pull-closed drive 21.

The pull-closed lever 7 comprises a guide groove 23 in which the pin 20 can be guided. The pull-closed lever 7 can in turn abut against a pin 24 on the ejector 6, and thus be able to be reliably guided in the lock 1. The pull-closed lever 7 comprises a recess 25 which can be brought into engagement with the extension 12 of the rotary latch 3 in an interlocking manner.

The arrester hook 8 can be brought into engagement with the lock holder 11. The arrester hook 8 is preferably spring-loaded in the direction of the lock holder 11 and would engage in the lock holder 11, without the electrical control means 9. The lock holder 11 is preferably designed a bracket, so that the arrester hook 8 can engage in the lock holder 11. In the embodiment shown, the arrester hook 8 has been moved, by the control means 9, in the direction of the arrow P2, and in particular has been pivoted in the direction of the arrow P2, in the clockwise direction. The arrester hook can be accommodated in the lock case 2, or in a part of the lock case 2 that is not shown, so as to be pivotably mounted.

FIGS. 2, 3 and 4 show the process of pulling closed, by the lock designed according to the invention, on the basis of the positions of lifting-off position in FIG. 2, securing position in FIG. 3, and locking position in position 4.

In the lifting-off position A, the lock holder 11 rests on the rotary latch 3 and the ejector 6, the lock holder 11 being held in the lifting-off position A by means of the ejector 6 and in part also by the rotary latch 3 that is spring-loaded in the anticlockwise direction. The drive lever 5 is in the initial position thereof.

The securing position S is shown in FIG. 3. The drive lever 5 has been pivoted in the clockwise direction, by means of the pull-closed drive 21 and in particular by means of the Bowden cable 22. The pivot movement causes the ejector 6 to be pivoted about the shaft 15 thereof in the anticlockwise direction, so that the lock holder 11, and in particular the lock holder 11 in combination with a load of a bonnet, moves into the securing position S. The pivot movement of the ejector 6 simultaneously causes the rotary latch 3 to be pivoted about the shaft 26, in the clockwise direction, by means of the lock holder 11, so that a cylinder pin 27 enters the engagement region of the recess 25 of the pull-closed lever 7. In said securing position S, the rotary latch 3 comes into engagement with the lock holder 11 in an interlocking manner, and the pull-closed lever 7 comes into engagement with the pin 27. At the same time, the pin 20 reaches the end of the guide groove 23, as a result of which the guide pin 20 is capable of transmitting a force to the pull-closed lever 7.

FIG. 4 shows the main ratchet position HR or locking position HR of the locking mechanism, in which the lock holder 11 is in the locking position. The rotary latch 3 is engaged with the pawl 4, so that the locking mechanism is closed and the lock holder 11 is secured in its position. The locking position HR is achieved by means of the drive lever 5 having been pivoted further in the clockwise direction by the force $F_B$ of the pull-closed drive 21. As a result of this movement, the pin 20 moves the rotary latch 3 into the locking position HR.

As can be clearly seen in FIGS. 2 and 3, the drive lever, and in particular the engagement ratios of the drive lever 5 on the ejector 6, provides a transmission ratio which can allow for swift, i.e. quick, lowering of the lock holder 11. After the securing position S has been reached, the drive lever interacts primarily with the pull-closed lever 7, resulting in a larger transmission ratio and a large force can be provided for locking the rotary latch or for transferring the lock holder 11 into the main ratchet position HR. The combination, and in particular the interaction, of the drive lever 5, ejector 6 and pull-closed lever 7 thus makes it possible to ensure a secure lock which also meets the requirements in particular of tightness of a door, bonnet or hatch that is moved by the lock according to the invention.

LIST OF REFERENCE SIGNS

1 lock
2 lock case
3 rotary latch
4 pawl
5 drive lever
6 ejector
7 pull-closed lever
8 arrester hook
9, 10 control means
11 lock holder
12 extension
13 contour
14 stop
15, 19, 26 shaft
16 first contact surface
17 second contact surface
18 driver
20 bearing, pull-closed and guide pin
21 pull-closed drive
22 Bowden cable
23 guide groove
24, 27 pin
25 recess
P1, P2 arrow
$F_F$ spring force
$F_B$ force Bowden cable

The invention claimed is:

1. A lock for a motor vehicle comprising:

a locking mechanism comprising a rotary latch and at least one pawl;

a lock holder;

an ejector lever that contacts the lock holder, wherein the lock holder is movable into a lifting-off position by the ejector lever;

at least one electrically actuatable drive for moving the lock holder from the lifting-off position into a locking position;

a drive lever that is movable by the at least one actuatable drive to be brought into engagement with the ejector lever to move the ejector lever which moves the lock holder into a securing position; and a pull-closed lever that is engageable with the drive lever, the rotary latch being configured to enter into engagement with the pull-closed lever during movement of the lock holder into the securing position, the drive lever being connectable to the rotary latch by the pull-closed lever only after the securing position of the lock holder is reached.

2. The lock according to claim 1, wherein the pull-closed lever can be brought into engagement with the drive lever only after the securing position is reached.

3. The lock according to claim 1, wherein the pull-closed lever can be brought into engagement with the rotary latch in an interlocking manner, in the securing position.

4. The lock according to claim 1, wherein the rotary latch can be brought into engagement with the lock holder in an interlocking manner, in the securing position.

5. The lock according to claim 1, wherein the rotary latch can be pivoted by the pull-closed lever, the rotary latch being transferrable from a position corresponding to the securing position of the lock holder into a position in which the rotary latch locks the lock holder in the locking position.

6. The lock according to claim 1, wherein the securing position can be determined by a locking position of a door or hatch of the motor vehicle that is movably connected to the motor vehicle, the locking position being definable by a clearance between the door or hatch and a motor vehicle body, wherein the securing position is reached when the clearance is 10 mm or less.

7. The lock according to claim 1, wherein the pull-closed lever comprises a recess that is engageable with the rotary latch.

8. The lock according to claim 1, wherein the rotary latch comprises an extension that is engageable with the pull-closed lever.

9. The lock according to claim 1, wherein the drive lever interacts with the ejector lever to transfer the lock holder from the lifting-off position into the securing position, and wherein the drive lever interact with the pull-closed lever to transfer the lock holder from the securing position into the locking position.

10. The lock according to claim 1, wherein the drive lever can be pivotably mounted in a lock case.

11. The lock according to claim 1, wherein the pull-closed lever can be guided and/or mounted in the drive lever.

12. The lock according to claim 6, wherein the securing position is reached when the clearance is 6 mm or less.

13. The lock according to claim 12, wherein the securing position is reached when the clearance is 4 mm or less.

14. The lock according to claim 8, wherein the extension is a cylindrical pin.

15. The lock according to claim 1 further comprising an arrester hook that is engageable with the lock holder.

16. The lock according to claim 1 further comprising an electrical control device that include at least one microdrive for moving the pawl.

17. The lock according to claim 1, wherein the ejector lever is pre-loaded whereby the lock holder is held in the lifting-off position.

18. The lock according to claim 1, wherein the ejector lever has a first contact surface that is engageable with the lock holder and a second contact surface that is engageable with the drive lever.

19. The lock according to claim 18, wherein the ejector lever is formed of metal and the first and second contact surface are bevel portions.

20. The lock according to claim 1, wherein the drive lever has a guide pin and the pull-closed lever has an elongated guide groove in which the pin is guided, wherein the pull-closed lever becomes coupled for movement with the drive lever after the pin reaches an end of the elongated guide groove.

* * * * *